US005292022A

United States Patent [19]

Blanco

[11] Patent Number: 5,292,022

[45] Date of Patent: Mar. 8, 1994

[54] CLOSURE FOR BEVERAGES METAL CONTAINERS

[76] Inventor: Arsenio G. Blanco, Villa de Marin, 26-6°, A, E-28029 Madrid, Spain

[21] Appl. No.: 861,976

[22] PCT Filed: Oct. 28, 1991

[86] PCT No.: PCT/ES91/00072

§ 371 Date: Jun. 30, 1992

§ 102(e) Date: Jun. 30, 1992

[87] PCT Pub. No.: WO92/07766

PCT Pub. Date: May 14, 1992

[30] Foreign Application Priority Data

Oct. 31, 1990 [ES] Spain ..... 9003134
Jul. 5, 1991 [ES] Spain ..... 9102145

[51] Int. Cl.[5] ..... B65D 51/20

[52] U.S. Cl. ..... 220/257; 220/258; 220/716; 220/718

[58] Field of Search ..... 220/716, 718, 257, 258, 220/214, 279, 266, 269, 270; 215/232

[56] References Cited

U.S. PATENT DOCUMENTS 3,204,805 9/1965 May ..... 220/258 X
3,690,509 9/1972 Kinoian et al. ..... 220/716
4,301,940 11/1981 Cvacho .
4,397,403 8/1990 Guimarin .
4,895,270 1/1990 Main et al. ..... 220/257
4,927,048 5/1990 Howard ..... 220/716

FOREIGN PATENT DOCUMENTS 0385954 9/1990 European Pat. Off. .
2156772 10/1985 United Kingdom .
8911421 11/1989 World Int. Prop. O. .

*Primary Examiner*—Allan N. Shoap
*Assistant Examiner*—Paul A. Schwarz
*Attorney, Agent, or Firm*—Helfgott & Karas

[57] ABSTRACT

A closure of a metallic container for beverages has at an opening thereof to be cleared, a pulling ring which, as it is pulled from the can, tears off a stamped surface defining that opening. The closure further includes a protective sheet applied to the stamped surface. The protective sheet is removed after pulling the ring, thereby preventing contamination by noxious substances the interior of the container upon opening.

1 Claim, 2 Drawing Sheets

CLOSURE FOR BEVERAGES METAL CONTAINERS

BACKGROUND OF THE INVENTION

1. Field of the Invention

The present invention relates to a closure that is particularly designed to be used in metal containers containing drinks, generally called "cans" or "tins", the structural chacteristics thereof being aimed at achieving the highest hygienic standards upon opening the container, in addition to providing the relevant closure.

2. Description of the Prior Art

Various systems exist within the field of canned drink closures to provide a can with a closure.

One such system involves making a continous notch along the perimeter of one of the can surfaces, at the same time attaching a ring to one of the ends thereof, whereupon the notched surface can be removed by pulling slightly to provide a wide outlet be provided for the liquid, which can even be drunk straight out of the can, by closing the mouth upon the opening provided. This system clearly has two drawbacks, to wit: the surface and ring provided for closure purposes are detached and these cutting objects are therefore to be found in the most inconvenient places; and secondly, in clear token of how little hygienic the use of the closure is upon opening, after handling and/or storage the surface that is to be removed from the container in order for the liquid therein contained to be able to exit, and the surface close to the portion removed, is in most cases soiled upon being used with substances that are harmful to health, and with micro-organisms that could well cause diseases to be passed on.

Another known system involves providing a notch, never actually making up a closed perimeter, upon one of the can surfaces, likewise providing some form of connecting at one of its ends, thereby for a slight effort to allow the notched surface to be pushed into the container, and for providing wide outlet for the liquid, that can even be drunk straight from the can by closing the mouth upon the opening provided. An aspect of this system is a clear token of how little hygienic the use of the seal is upon opening, for after handling and/or storage the surface that is to be pushed into container in order for the liquid therein contained to be able to exit, and the surface close to this portion, is in most cases soiled upon being used with substances that are harmful to health, and with microorganisms that could well cause diseases to be passed on.

In an attemp at solving this problem, European Patent EP-0 385 954 is known where the notched surface is covered with an adhesive sheet which runs right up to the areas that surround the upper base of the can, leaving its manually operated ring free, and that is detached upon pulling from the ring, together with the portion of a torn plate attached to the latter.

In this European Patent the problem posed by the detachment of the tearable surface and the pulling ring remains, because these elements can be disposed of independently from the can as such, and in addition the solution of the second aspect is only partial, above all when the contents are consumed directly from the inside of the container and also when pouring into a cup or other receptacle is not effected in a single operation, because in such event liquid waste remains upon the upper can base and reaches all of its surface, hence being contaminated with germs or dirt that the same may have upon the unprotected area of such base, returning towards the pouring area when the can is tilted.

U.S. Pat. No. 4,397,403 seems to provide the opposite solution, viz. the problem of not rendering the notched surface independent upon opening the can is solved, and yet no solution, albeit partially, is provided for the contamination problem of the contents of the can when the latter is opened.

SUMMARY OF THE INVENTION

The closure for canned drinks, subject of the invention, provides an entirely new solution which fully overcomes the problems posed by the above-described conventional systems, allowing the container to be hygienically closed by simple means.

More specifically and in order to achieve the above, the closure system of the present invention comprises a surface that is die-formed throughout its perimeter as it is notched saving at one of its ends, the latter feature such that it may bend without being easily severed or torn off. A reinforcement die-form is provided on either side of the surface and inside the surface which surrounds the latter. A concave die-form is also provided in order for the ring joined to the surface that is to be taken from its closure position, to be grasped. Covering the surface to be removed in order to allow the liquid to exit and also form a wide surface surronding the surface as a hygienic adhesive protector.

In a preferred embodiment, the protective sheet is provided to cover the upper base of the can entirely, being located under the pulling ring used for opening purposes. In particular the said sheet has a preformed perimetric hoop such that when the same is severed it tends to roll itself up, draging with it the protective sheet, to which end the hoop is provided with a weak point therein, closest to the area where the outlet mouth of the can is located. The weak point is joined to the ring opening of the can through an auxiliary rib which transmits the necessary strain to sever the hoop upon pulling the ring.

Furthermore, in this embodiment, the protective laminar body is provided with a diametric weak line which is capped at one of its ends by the weak point on the perimetric hoop, fostering the ripping and splitting into two halves of the said protective sheet when the retractable hoop rolls itself up.

The closure could also comprise a plastic "top", placed upon the surface holding the outlet mouth for the liquid, ensuring that the surface through which the liquid exits is hygienic, such being the primary object of this invention.

The practical use of the closure system brings about a number of advantages from both a hygienic and other standpoints, that could be summed up as follows:

- Preventing the access of harmful substances upon opening the can.
- Preserving the hygienic standard existing upon canning on the surface which surrounds the outlet mouth and is covered by the hygienic adhesive protector.
- The ring is not detached and hence cutting objects are not left lying around.

BRIEF DESCRIPTION OF THE DRAWINGS

In order to provide a detailed description and contribute to the complete understanding of the characteristics of this invention, a set of drawings is attached to the specification which, while purely illustrative and not fully comprehensive, shows the following.

DESCRIPTION OF THE PREFERRED EMBODIMENT OF THE INVENTION

Figure 1:
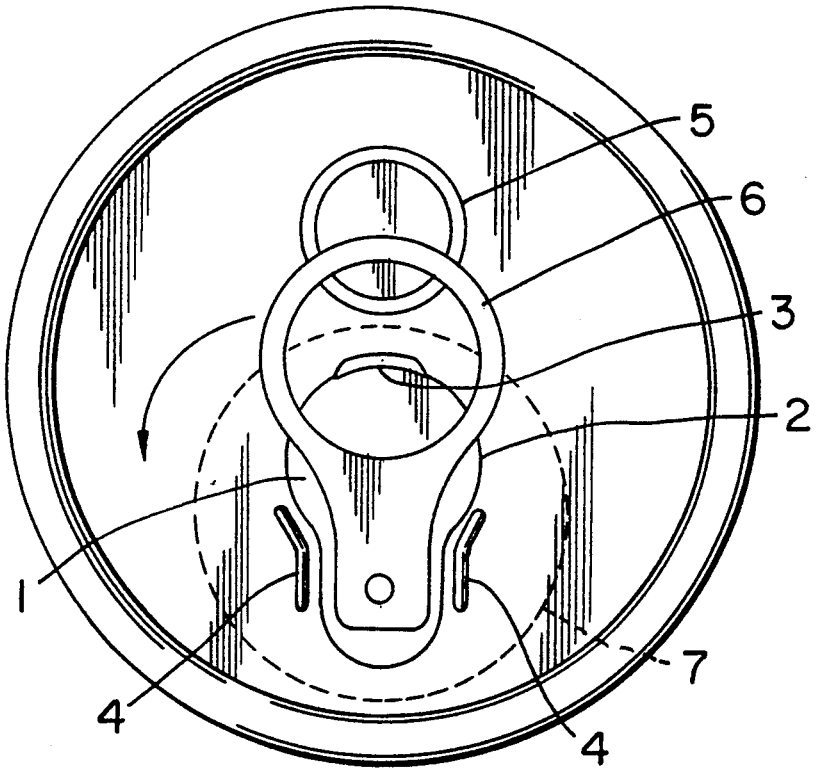
FIG. 1 is a top plan view of a metal container to which the closure of the present invention can be applied.

It can in light of FIG. 1 be observed that the closure of the invention basically comprises a surface 1 having a notched contour 2 saving for an end sector 3 which is merely die-formed and has no notch, thereby to allow bending and prevent easy severing. Die-forms 4 are provided on either side of the outlet mouth obtained upon removing the surface 1 in order for the surface which surrounds the outlet mouth to be reinforced. A concave die-form 5 is also provided in order that a pulling ring 6 is easier to grasp, such ring being provided with an internal reinforcement fold. Covering the outlet mouth and likewise a wide surface borders the mouth is an adhesive protector 7 acting as a hygienic means to prevent potentially hazardous agents from contacting the surface 1.

With this structure, the protector 7, which makes up the hygienic adhesive, will be removed upon pulling from the ring 6, leaving the mouth clear and clean to be used.

Naturally, the seal is used in practice by merely turning the ring 6 about half-turn, pulling the same until the outlet mouth is cleared, and in doing so removing the hygienic adhesive protector 7, thereby ensuring good hygienic conditions for the outlet mouth.

Figure 2:
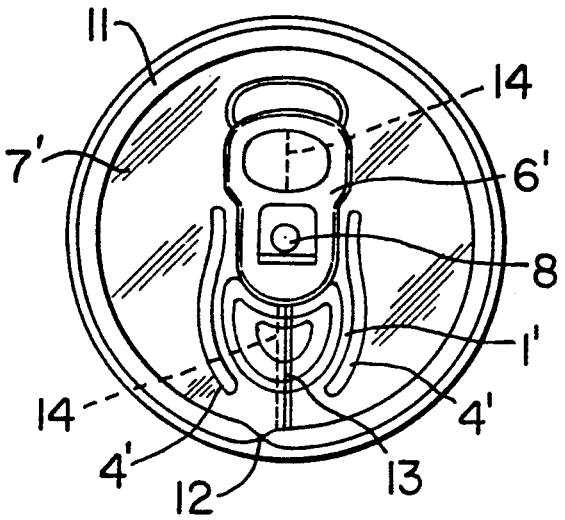
FIG. 2 is a top plan view of a preferred embodiment of the closure, showing for illustrative purposes a different form of the pulling ring, this embodiment being provided with a plastic sheet covering the upper can base entirely.
Figure 3:
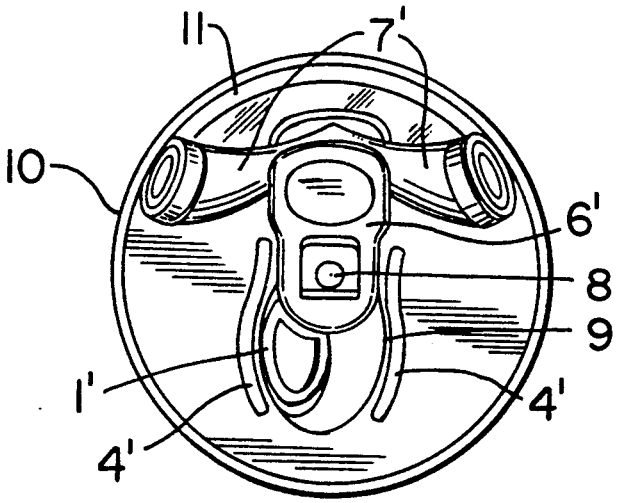
FIG. 3 is a top view similar to the above, but with the container open, showing the hole or opening defined upon pulling the ring and after the protective sheet has been duly rolled up.

In a preferred embodiment, shown in FIGS. 2 and 3, a top is shown with the same ring-based sealing system, though with a different configuration, such that in FIGS. 2 and 3 the relevant top includes a ring 6′ of a different configuration, but attached to the top by means of a usual rivet 8, such that upon tilting the ring 6′, as is also the norm, a tab defining the surface 1′ framed by the relevant dieformed contour, is severed, whereupon after the severance of such surface 1′ or tab the relevant opening 9 to empty the contents shall be obtained. In this case stiffening ribs 4′ can also be seen on either side of the stamped contour defining the tab or tearable surface 1′ when the relevant ring 6′ is pulled.

Now, from the characteristics, that are the same as those mentioned above in respect of the closure shown in FIG. 1, though with a different geometrical shape, this embodiment is particular in that the hygienic protective sheet 7′ formally and dimensionally matches vase 10, such protective sheet 7′ having a perimetric hoop 11 that is preferably a part of it, namely a retractable loop that is tautly preformed such that upon severing the same, each of its two halves shall roll themselves up, as shown in FIG. 3, to which end the hoop 11 is provided with a weak point 12 at which it to sever, and at the same time, and an auxiliary rib 13 that is also part of the protective sheet 7′, acting as a mechanical transmission for the above-mentioned severance, is provided between the opening ring 6′ and the severance point 12.

Finally and to supplement the above structure, the protective sheet 7′ is also provided with a weak line 14, largely along its diameter, parallel and close to the auxiliary rib 13, as shown in FIG. 2, such that just as the retractable hoop 11 is severed and rolls itself up, the protective sheet 7′ is severed and thus, as shown in FIG. 3, after the can has been opened, in order f or the outlet mouth or opening 9 thereof to be cleared, the protective sheet 7′ is duly displaced and rolled up at one end of the base opposite the pouring mouth or opening 6.

I claim:

1. A closure for metallic beverage containing containers, the closure comprising an end wall, a ring connected to a tearable portion for exposing an opening in the end wall when said portion is torn upon pulling of said ring; and a hygienic protective sheet which is located below said ring and which entirely covers said end wall, said hygienic protective sheet including a planar portion and a hoop portion extending along a perimeter thereof, said hoop portion having a weak area and being tautly preformed such that, upon being severed at said weak area when said ring is pulled, said hoop portion is divided into two halves which roll themselves up dragging along said planar portion, said planar portion including an auxiliary rib radially extending over said tearing portion from said weak area to said ring and a weak line extending parallel to and close to said auxiliary rib between said weak area and said ring to ensure severance and division of said hoop portion and said planar portion along with said hoop portion into two halves which roll up exposing said opening and a hygienically clean area around said opening as said ring is pulled.

* * * * *